US007581530B2

(12) United States Patent
Scheffel et al.

(10) Patent No.: US 7,581,530 B2
(45) Date of Patent: Sep. 1, 2009

(54) SUPPORT ELEMENT

(75) Inventors: Martin Scheffel, Vaihingen (DE); Werner Berger, Markgroeningen (DE); Anh-Tuan Hoang, Tamm (DE); Jens Pohlmann, Besigheim (DE); Martin Buehner, Backnang (DE); Thomas Froehner, Karlsruhe (DE); Cedric Olivier, Freiberg am Neckar (DE); Martin Andorfer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/581,002

(22) PCT Filed: Nov. 12, 2004

(86) PCT No.: PCT/EP2004/052943

§ 371 (c)(1),
(2), (4) Date: Aug. 20, 2007

(87) PCT Pub. No.: WO2005/059348

PCT Pub. Date: Jun. 30, 2005

(65) Prior Publication Data

US 2008/0105236 A1 May 8, 2008

(30) Foreign Application Priority Data

Dec. 17, 2003 (DE) ..... 103 59 299

(51) Int. Cl.
*F02M 61/14* (2006.01)
*F02M 61/18* (2006.01)

(52) U.S. Cl. ..... 123/470

(58) Field of Classification Search ..... 123/470, 123/456, 467, 468, 469, 447; 239/600
See application file for complete search history.

(56) References Cited

U.S. PATENT DOCUMENTS

| | | | | |
|---|---|---|---|---|
| 4,294,215 | A | 10/1981 | Hans et al. | |
| 4,474,160 | A | 10/1984 | Gartner | |
| 4,993,390 | A | 2/1991 | Ono et al. | |
| 5,074,269 | A | 12/1991 | Herbon et al. | |
| 5,803,052 | A * | 9/1998 | Lorraine et al. | 123/470 |
| 5,893,351 | A * | 4/1999 | Akutagawa et al. | 123/470 |
| 5,904,221 | A | 5/1999 | Breitweg et al. | |
| 5,970,953 | A | 10/1999 | Lorraine et al. | |
| 6,053,149 | A * | 4/2000 | Lorraine | 123/470 |
| 6,276,339 | B1 | 8/2001 | Shebert, Jr. | |
| 6,481,420 | B1 * | 11/2002 | Panasuk et al. | 123/470 |
| 6,668,803 | B1 * | 12/2003 | McClean et al. | 123/470 |
| 6,830,037 | B1 * | 12/2004 | Braun et al. | 123/470 |
| 7,210,462 | B2 * | 5/2007 | Scheffel et al. | 123/470 |
| 2005/0224053 | A1 * | 10/2005 | Scheffel et al. | 123/470 |
| 2007/0175450 | A1 * | 8/2007 | Eckbauer et al. | 123/470 |

FOREIGN PATENT DOCUMENTS

| | | |
|---|---|---|
| DE | 29 26 490 | 2/1981 |
| DE | 93 12 825.8 | 1/1995 |

(Continued)

*Primary Examiner*—Mahmoud Gimie
(74) *Attorney, Agent, or Firm*—Kenyon & Kenyon LLP

(57) ABSTRACT

A support element is provided for the mutual support of a fuel injector in a valve receptacle, e.g., the valve receptacle of a cylinder head of an internal combustion engine, and of the fuel injector against a fuel distribution line. The support element has a clamp, clips and brackets.

22 Claims, 5 Drawing Sheets

FOREIGN PATENT DOCUMENTS

| | | |
|---|---|---|
| DE | 197 56 102 | 6/1999 |
| DE | 198 51 791 | 3/2000 |
| DE | 100 02 005 | 8/2001 |
| DE | 100 58 015 | 5/2002 |
| DE | 101 63 030 | 7/2003 |
| GB | 206 666 | 11/1923 |
| JP | 02-008424 | 1/1990 |
| JP | 2125958 | 5/1990 |
| JP | 9512763 T | 12/1997 |
| JP | 2003-254629 | 9/2003 |
| WO | WO 00/16023 | 3/2000 |
| WO | WO 03/038267 | 5/2003 |

* cited by examiner

SUPPORT ELEMENT

FIELD OF THE INVENTION

The present invention is directed to a support element for maintaining clearance between a fuel injection line and a fuel injector inserted into a cylinder head of an internal combustion engine.

BACKGROUND INFORMATION

An attachment device for attaching a fuel injector to an intake manifold, in which the fuel injector is axially fixed to the fuel distribution line and to a plug nipple via an attachment element designed as a U-shaped securing clamp having two legs which are flexible in the radial direction, is described, e.g., in published German patent document DE 29 26 490. When mounted, the securing clamp extends through corresponding notches in the plug nipple and can be clicked into place in a recess designed as an annular groove in a connector piece of the fuel injector. The axial play between the notches and the securing clamp and between the annular groove and the securing clamp is to be kept to a minimum, so that the fuel injector may be fixed precisely in place without strain on the seal.

The disadvantage of the attachment device disclosed in published German patent document DE 29 26 490 is the fact that the various holding components exert strain upon the fuel injector. The resulting flux of force in the fuel injector results in deformations and thereby in changes in the lift and even seizure of the valve needle, and also results in pressure load or bending load on the housing components, which as a general rule have thin walls and are welded to one another at various points. Moreover, every attachment means, e.g., a contact collar, increases the radial dimension of the fuel injector, which in turn means more space is required for installation.

SUMMARY

The support element according to the present invention for a fuel injector has the advantage that the fuel distribution line rests against the fuel injector via the support element without any radial force being exerted, which means there is no damage to the fuel injector or to the fuel distribution line connector. Due to appropriately designed brackets and clips, the support element ensures that the hold-down force of the fuel distribution line is transferred onto the fuel injector, and also allows fixing to be flexible so that tolerances and offsets are compensated for.

It is advantageous that the support element may be manufactured in a straightforward manner by stamping sheet metal. It may also be manufactured via deep-drawing and stamping.

It is advantageous that in the case of the support element according to the present invention there are no screws or tensioned claws for attaching the fuel injector to the front of the cylinder head.

It is advantageous that stamped recesses which are easy to produce ensure that the support element is securely fixed to the fuel injector and that the fuel distribution line is supported in a simple manner.

The various clip configurations are advantageously designed so that greater or lesser elastic and plastic deformation allows the support between the fuel distribution line and the fuel injector to be optimized in accordance with the installation situation.

DETAILED DESCRIPTION

FIGS. 1A through 1D show various schematic views of a first exemplary embodiment of a support element 3 according to the present invention for fixing a fuel injector 1 in cylinder head 12 of an internal combustion engine and for connecting fuel injector 1 to fuel distribution line 2.

Figure 1A:
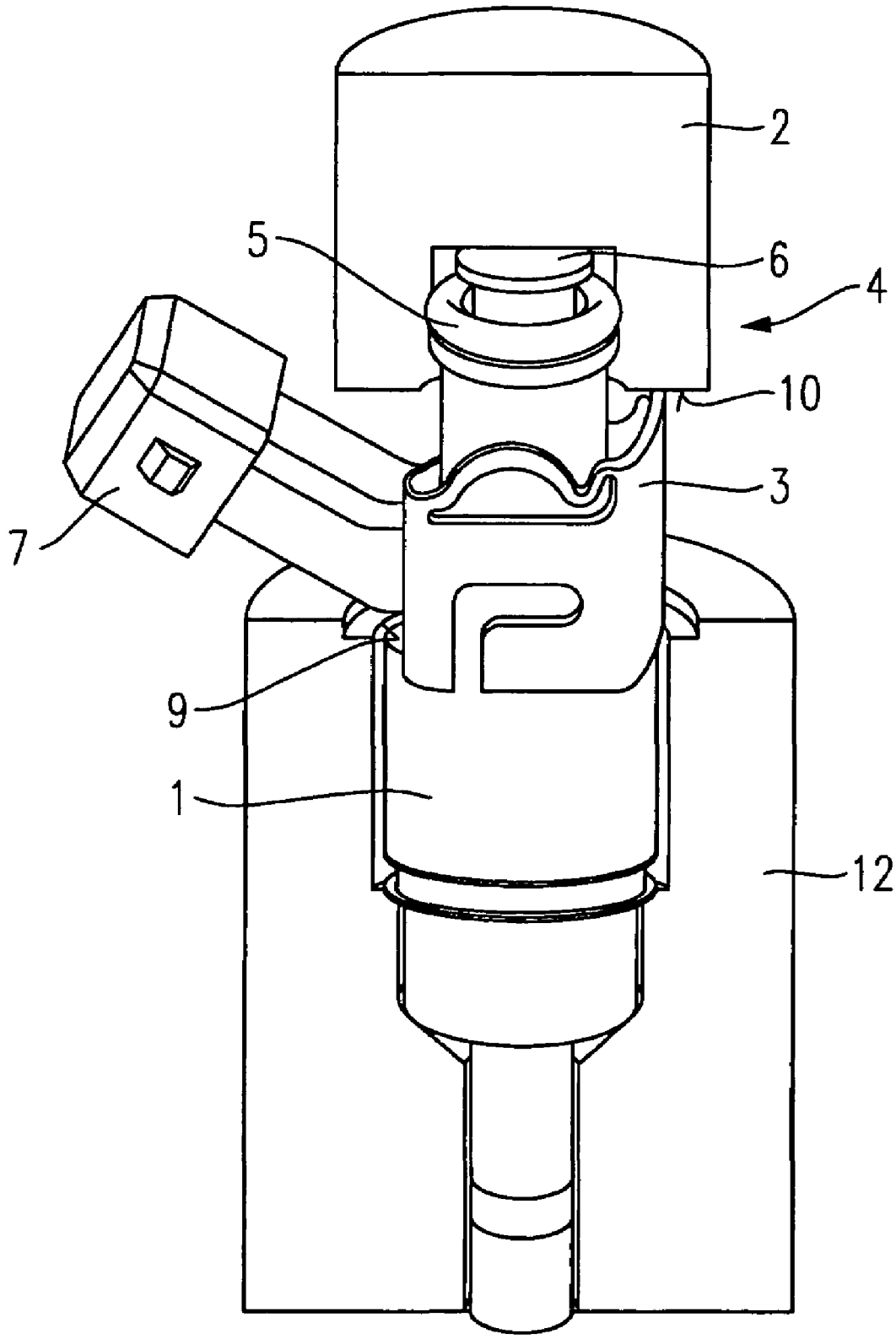
FIGS. 1A-1D show various schematic views of a first exemplary embodiment of a support element according to the present invention for a fuel injector.

FIG. 1A schematically shows, in a partial-section perspective view, how support element 3 along with fuel injector 1 are installed.

Fuel injector 1 is in the form of direct-injection fuel injector 1, which may be used in a valve receptacle of cylinder head 12 to directly inject fuel into a combustion chamber of an explosion-type spark-ignition internal combustion engine (not shown). The valve receptacle may also be provided on a mounting connector piece of an intake manifold (not shown). Fuel injector 1 has, on feed end 4, a plug connection to a receptacle connector piece of fuel distribution line 2, which is sealed by seal 5 between fuel distribution line 2 and inflow connector element 6 of fuel injector 1. Fuel injector 1 has electrical terminal 7 for creating electrical contact for actuation of fuel injector 1. To ensure that clearance is maintained between fuel injector 1 and fuel distribution line 2 without radial force being exerted, support element 3 is provided according to the present invention. Support element 3 includes clamp 8, which rests against shoulder 9 of fuel injector 1 and is supported by shoulder 10 of fuel distribution line 2. Clamp 8 has a slit in the area of electrical connector 7 of fuel injector 1, to facilitate assembly.

Figure 1B:
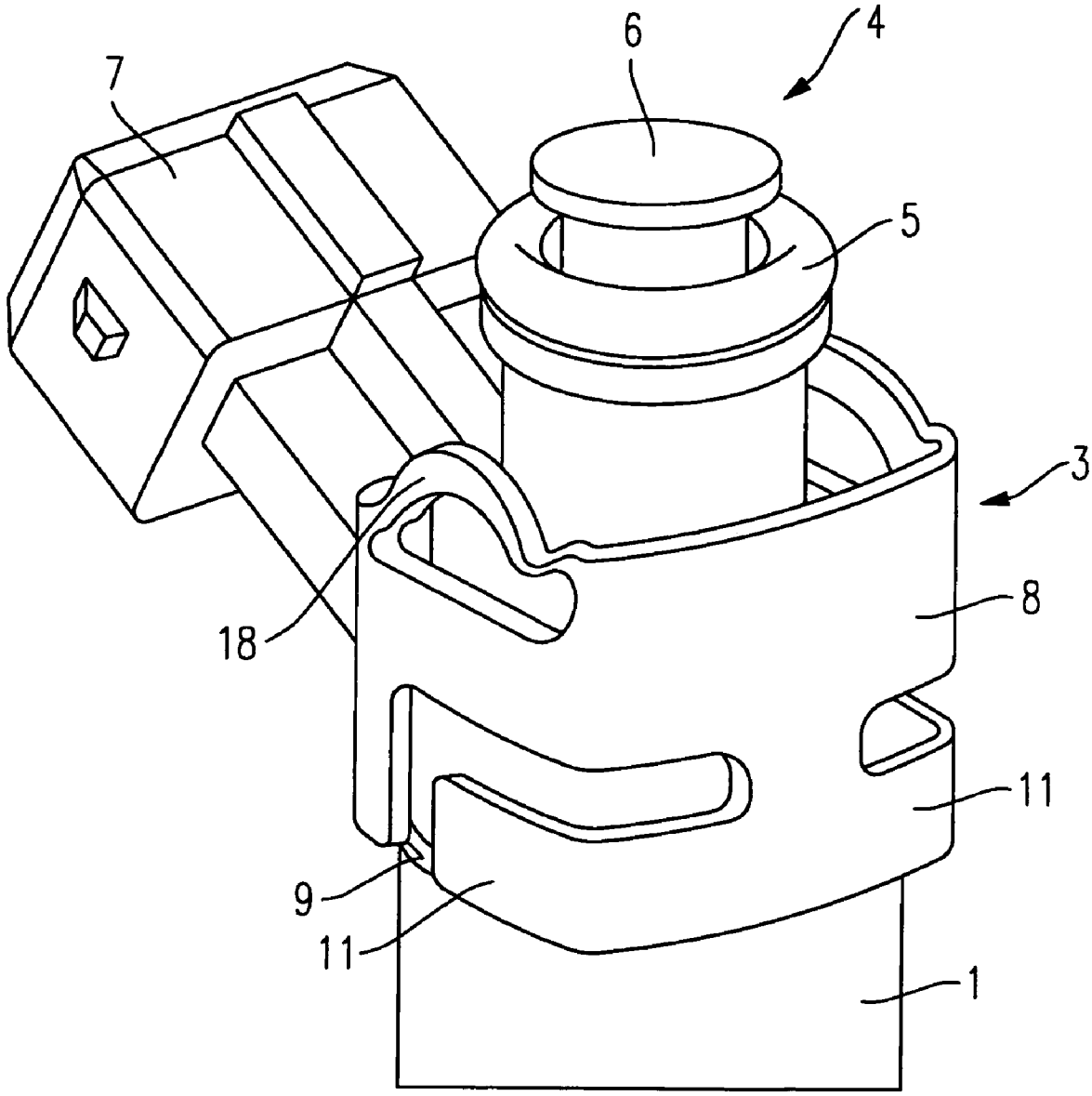

FIG. 1B shows how clamp 8 is placed on fuel injector 1 and rests against shoulder 9.

Figure 1C:
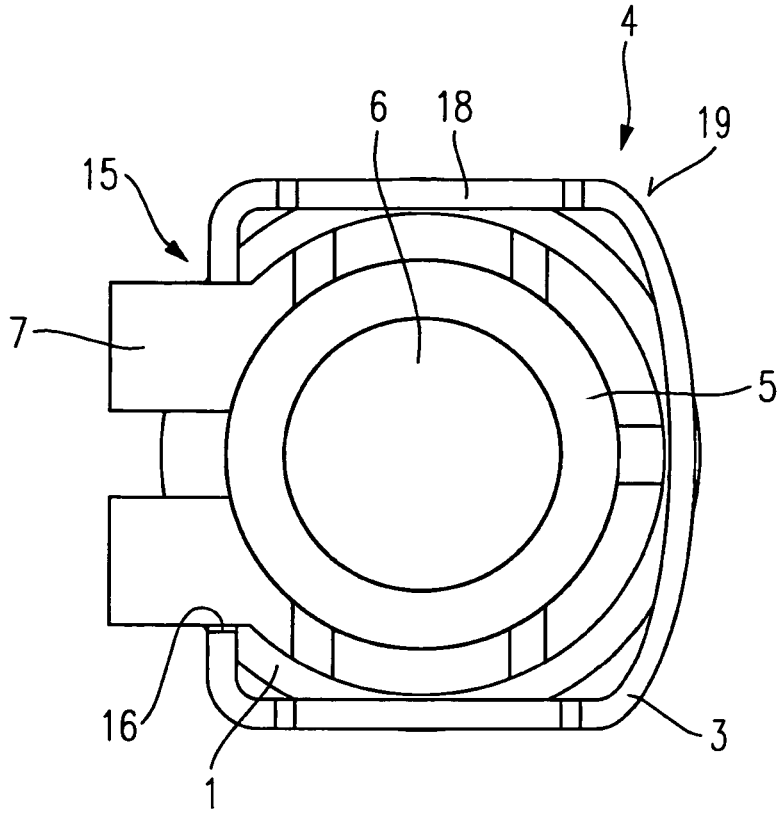
Figure 1D:
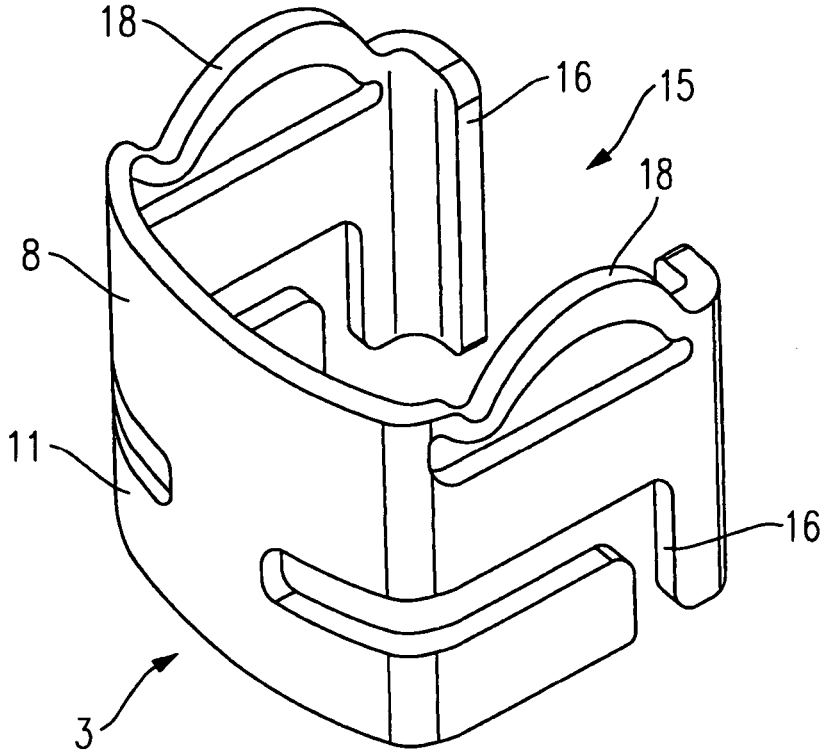

As shown in particular in FIG. 1D, in the first exemplary embodiment two clips 11 and two brackets 18 are provided on clamp 8 and ensure that fuel distribution line 2 is flexibly braced against fuel injector 1. Clips 11 are responsible for a radial clamping effect and brackets 18 are responsible for axial elasticity. Clips 11 rest against shoulder 9 of fuel injector 1, and brackets 18 rest against shoulder 10 of fuel distribution line 2.

Due to their shape and arrangement on clamp 8, brackets 18 are plastically-elastically deformable under axial load and as a result transfer axial force onto fuel injector 1.

FIG. 1C shows a top view of the first exemplary embodiment of support element 3 according to the present invention, in mounted position on fuel injector 1. To prevent support element 3 from shifting due to the axial force exerted by fuel distribution line 2, which would result in strain on fuel injector 1 in the cylinder head and bending of fuel injector 1 resulting in improper functioning, e.g., a stuck valve needle of fuel injector 1, support element 3 is not round but rather has a roughly rectangular or quadrangular cross section. In addition, edges 16, which form the ends of clamp 8 on both sides of slit 15, are folded radially inward toward fuel injector 1. As a result, edges 16 rest against fuel injector 1 along their entire axial length, thus keeping support element 3 from slipping.

When support element 3 has been installed, electrical connector 7 of fuel injector 1 is in the area of slit 15.

Figure 2:
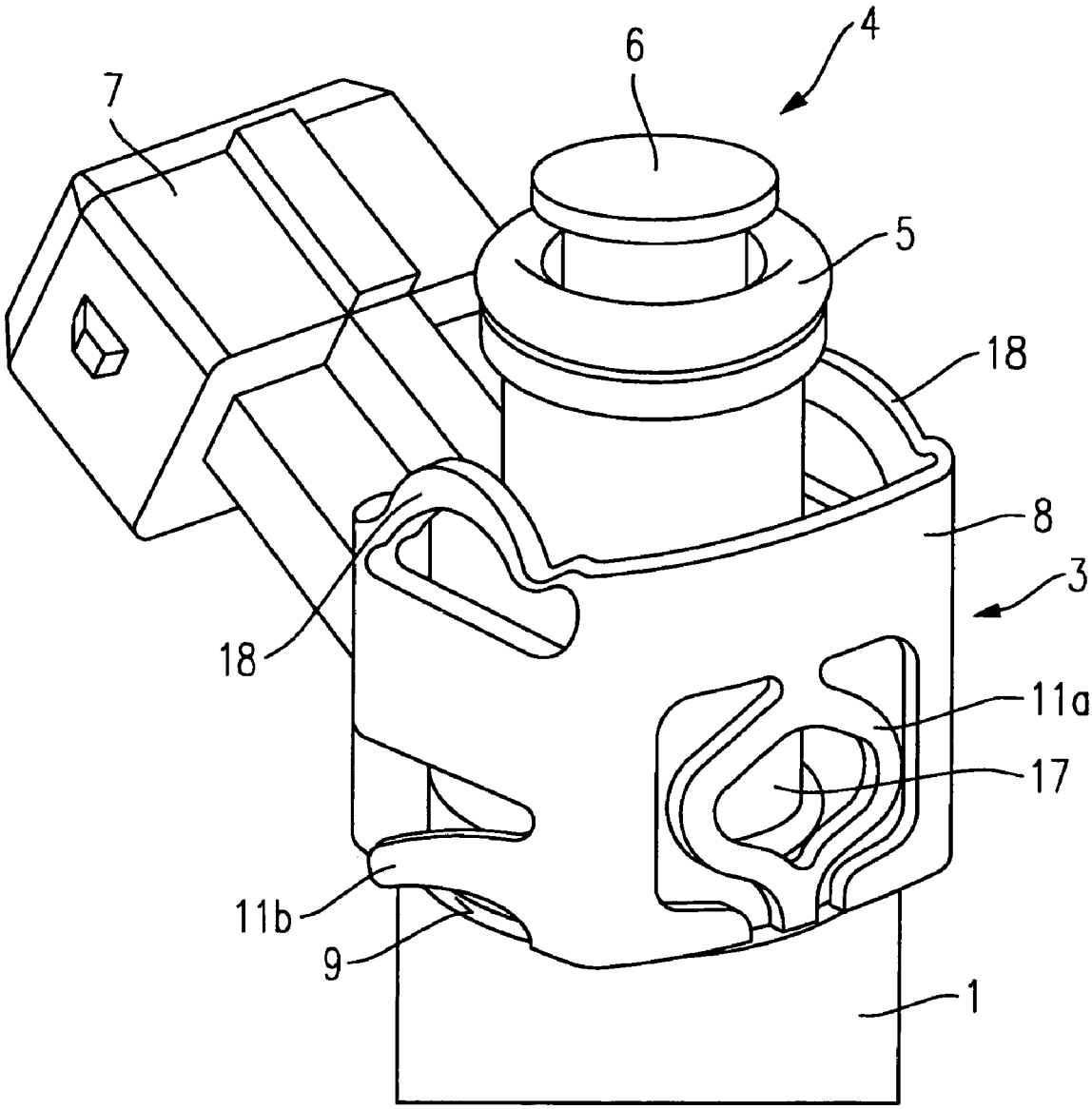
FIG. 2 shows a schematic perspective view of a second exemplary embodiment of a support element according to the present invention.

In FIG. 2, a second exemplary embodiment of support element 3 according to the present invention is shown. The support element has clips 11 having different shapes, which are connected to clamp 8. In the exemplary embodiment, two clips 11*b* opposite one another are tongue-shaped, and a third clip 11*a* is roughly onion-shaped. A reverse alternative arrangement with two onion-shaped clips 11*a* and one tongue-shaped clip 11*b* is also feasible. Recess 17 in clip 11*a* ensures that clip 11*a* has high elasticity and thus greater tolerance with regard to stress. Edges 16 may be designed as shown in FIGS. 1A through D.

Figure 3:
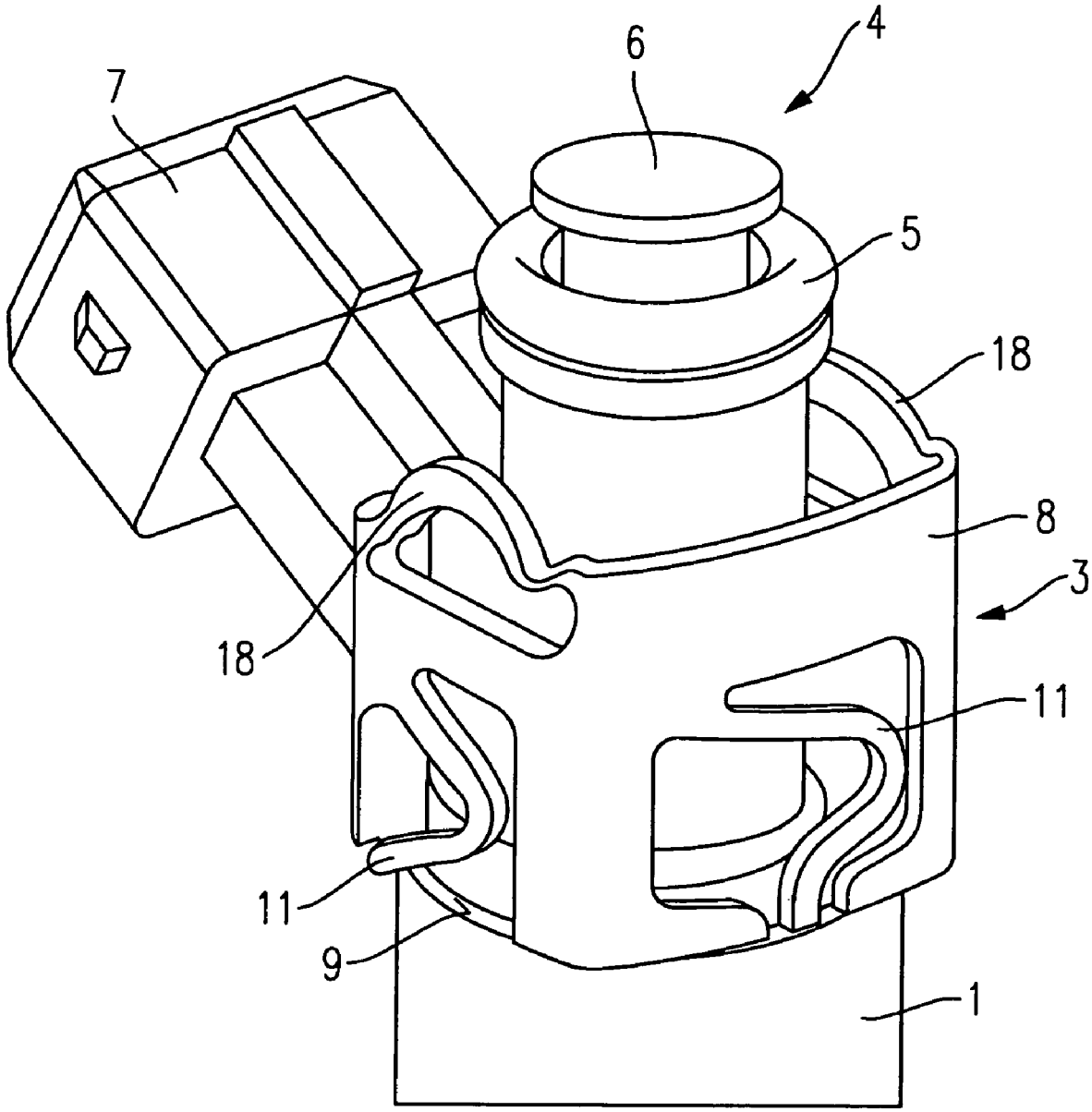
FIG. 3 shows a schematic perspective view of a third exemplary embodiment of a support element according to the present invention.

FIG. 3 shows a third exemplary embodiment of support element 3 according to the present invention. It has clips 11 which in terms of shape constitute a combination of tongue-shaped clips 11*b* and onion-shaped clip 11*a* of the second exemplary embodiment described above. The shape shown is easier to manufacture, but nonetheless has high elasticity and flexibility for offsetting radial and axial loads. Edges 16 may also be designed as shown in FIGS. 1A-D.

Because the components are flexibly braced against one another, axial loads exerted by fuel distribution line 2, and also manufacturing tolerances and changes in length due to heating when the internal combustion engine is in operation, may be offset.

The present invention is not limited to the exemplary embodiments shown, and for example may also be used for fuel injectors 1 for injecting fuel into the combustion chamber of a compression-ignition internal combustion engine. In particular, support element 3 shown in the figures may also be mounted in reverse position so that brackets 18 rest against shoulder 9 of fuel injector 1 instead of against shoulder 10 of fuel distribution line 2.

The invention claimed is:

1. A support element for mutually supporting a fuel injector in a valve receptacle of a cylinder head of an internal combustion engine, as well as mutually supporting the fuel injector against a fuel distribution line, comprising:

a clamp body;

at least two clips extending from the clamp body and configured to interact with one of the fuel injector and the fuel distribution line; and at least two brackets extending axially from the clamp body and configured to interact with one of the fuel injector and the fuel distribution line;

wherein the brackets are axially deformable at least one of elastically and plastically under an axial load applied by one of the fuel injector and the fuel distribution line.

2. The support element as recited in claim 1, wherein the brackets rest against a shoulder of the fuel distribution line.

3. The support element as recited in claim 2, wherein the clips rest against a shoulder of the fuel injector.

4. The support element as recited in claim 1, wherein the brackets rest against a shoulder of the fuel injector.

5. The support element as recited in claim 4, wherein the clips rest against a shoulder of the fuel distribution line.

6. The support element as recited in claim 3, wherein the number of brackets is exactly two.

7. The support element as recited in claim 6, wherein the number of clips is exactly two.

8. The support element as recited in claim 7, wherein the clips radially grasp the fuel injector.

9. The support element as recited in claim 3, wherein the number of clips is three.

10. The support element as recited in claim 9, wherein the three clips have the same shape.

11. The support element as recited in claim 10, wherein the three clips each have at least one curve.

12. The support element as recited in claim 9, wherein the clips have different shapes.

13. The support element as recited in claim 9, wherein two of the three clips have the same shape.

14. The support element as recited in claim 13, wherein at least one of the three clips has a tongue shape.

15. The support element as recited in claim 13, wherein at least one of the three clips has an onion shape.

16. The support element as recited in claim 15, wherein the at least one clip having an onion shape has a hole.

17. The support element as recited in claim 3, wherein the clamp body has a slit that is positioned in the area of an electrical connector of the fuel injector.

18. The support element as recited in claim 17, wherein the clamp body is made of stamped spring steel.

19. The support element as recited in claim 17, wherein the clamp body has axial edges that are folded radially inward and rest against the fuel injector.

20. The support element as recited in claim 19, wherein the support element has a substantially rectangular profile when viewed from the top.

21. The support element as recited in claim 3, wherein the fuel injector is braced against the fuel distribution line via the support element.

22. The support element as recited in claim 21, wherein the support element is guided through the cylinder head of the internal combustion engine.

* * * * *

UNITED STATES PATENT AND TRADEMARK OFFICE

CERTIFICATE OF CORRECTION

PATENT NO. : 7,581,530 B2
APPLICATION NO. : 10/581002
DATED : September 1, 2009
INVENTOR(S) : Scheffel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 74 days.

Signed and Sealed this

Fourteenth Day of September, 2010

David J. Kappos

David J. Kappos
*Director of the United States Patent and Trademark Office*